US006163560A

United States Patent [19]

Poloni et al.

[11] Patent Number: 6,163,560

[45] Date of Patent: Dec. 19, 2000

[54] METHOD TO PROCESS FUMES AND RELATIVE DEVICE

[75] Inventors: Alfredo Poloni, Fogliano di Redipuglia; Matteo Vittorio Losciale; Milorad Pavlicevic, both of Udine, all of Italy

[73] Assignee: Danieli & C Officine Meccaniche SpA, Buttrio, Italy

[21] Appl. No.: 09/403,300

[22] PCT Filed: Apr. 20, 1998

[86] PCT No.: PCT/IB98/00590

§ 371 Date: Oct. 20, 1999

§ 102(e) Date: Oct. 20, 1999

[87] PCT Pub. No.: WO98/48220

PCT Pub. Date: Oct. 29, 1998

[30] Foreign Application Priority Data

Apr. 22, 1997 [IT] Italy ..... GO97A0010

[51] Int. Cl.[7] ..... F27D 17/00

[52] U.S. Cl. ..... 373/9; 373/8; 373/80

[58] Field of Search ..... 373/2, 8, 9, 78, 373/80; 432/210, 72; 423/210; 110/213, 216, 264

[56] References Cited

U.S. PATENT DOCUMENTS

| | | | |
|---|---|---|---|
| 3,843,329 | 10/1974 | Longley . | |
| 3,898,317 | 8/1975 | Hemsath et al. | 423/210 |
| 4,124,681 | 11/1978 | Reed et al. | 423/210 |
| 4,437,186 | 3/1984 | Inai | 373/9 |
| 4,526,678 | 7/1985 | Myhren et al. | 373/9 |
| 4,611,339 | 9/1986 | Saitoh | 373/80 |
| 4,867,676 | 9/1989 | Buzetzki | 432/96 |
| 5,265,117 | 11/1993 | Pernet et al. | 373/9 |
| 5,787,108 | 7/1998 | Pavlicevic et al. | 373/9 |

FOREIGN PATENT DOCUMENTS

| | | |
|---|---|---|
| 0338183 | 10/1989 | European Pat. Off. . |
| 0409037 | 1/1991 | European Pat. Off. . |
| 0490283 | 6/1992 | European Pat. Off. . |
| 2105394 | 4/1972 | France . |

*Primary Examiner*—Tu Ba Hoang
*Attorney, Agent, or Firm*—Stevens, Davis, Miller & Mosher, LLP

[57] ABSTRACT

Method to process fumes performed on fumes discharged directly from furnaces (10) through an aperture (11) in their roof or from loading baskets (13) used to pre-heat scrap which is to be loaded into a furnace, the fumes (17) afterwards being sent to a purification plant (24) and to a chimney, the fumes (17) leaving the furnace (10) and/or the loading baskets (13) through a cooled conduit (14) being made to pass through at least a first transit chamber where they are subjected to a post-combustion process before being sent to the purification plant (24) and the chimney, the first transit chamber being a first expansion chamber and the fumes entering the first expansion chamber **(15*a*) expanding in correspondence with a wider section (215*a*) therein at the entrance thereto and being deflected by a deflector element (18) arranged substantially at the center of the wider section (215*a*), the expansion and deflection causing the fumes to decelerate from a speed at the inlet of around 20 to 50 meters per second to a speed at the outlet of around 5 to 12 meters per second, the fumes then being subjected to a post-combustion process by means of at least one burner (20) arranged on the walls of the first expansion chamber (15*a*) and below the deflector element (18)**.

20 Claims, 2 Drawing Sheets

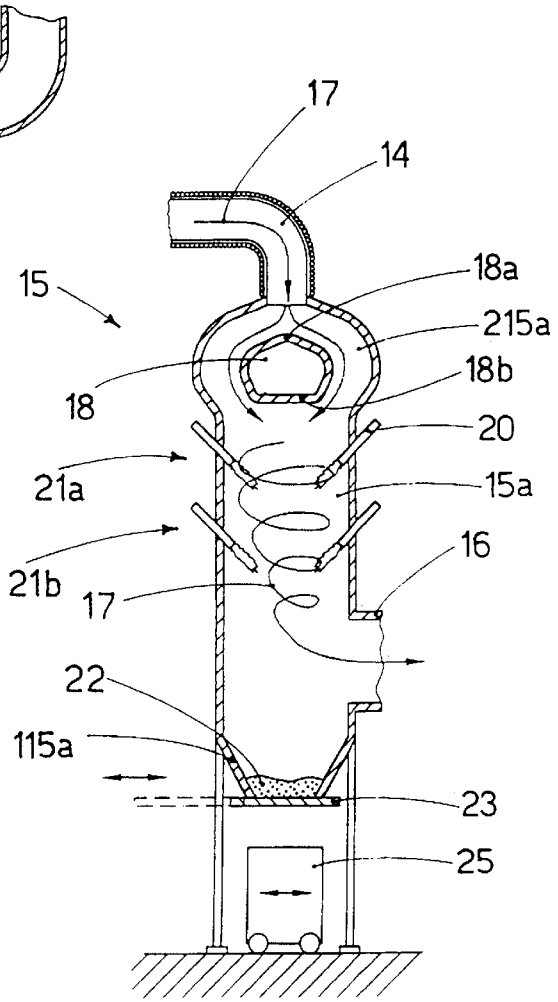
fig. 2
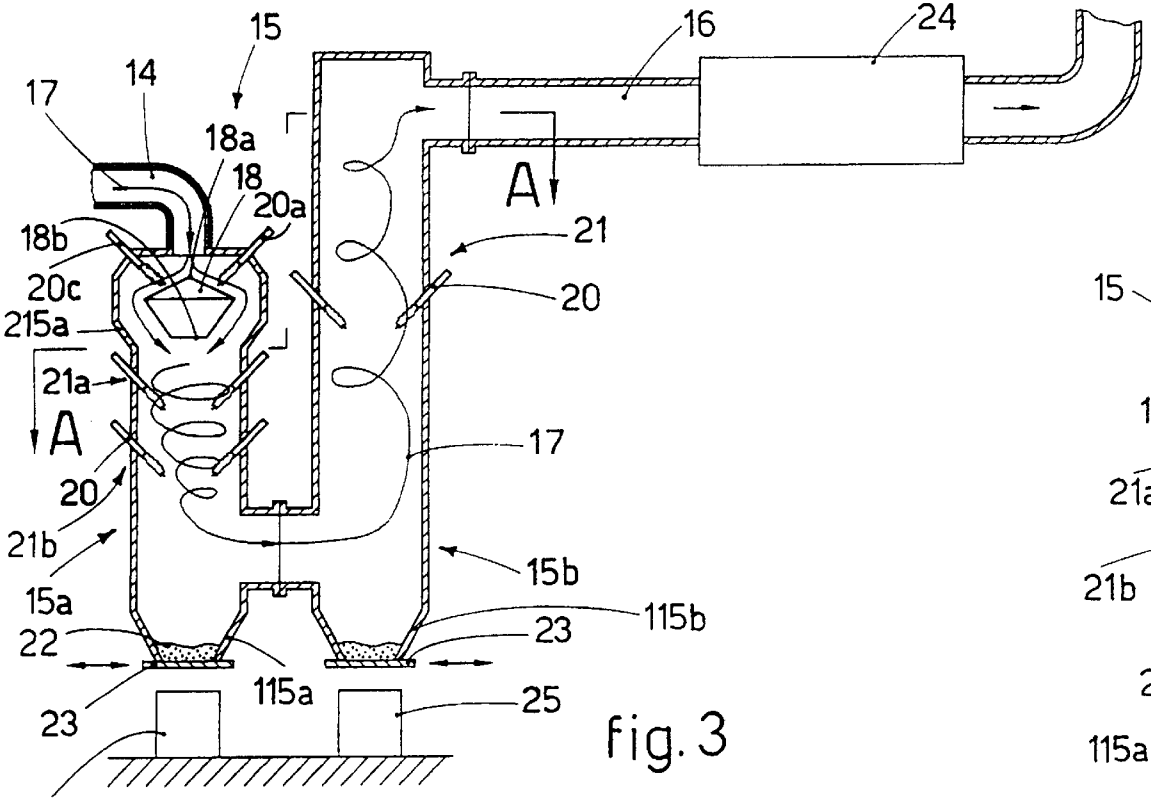
fig. 3
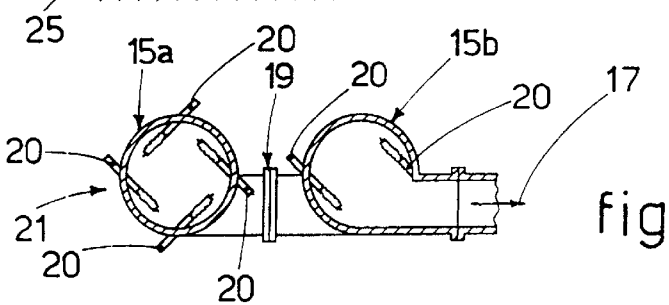
fig. 4 (A-A)

METHOD TO PROCESS FUMES AND RELATIVE DEVICE

FIELD OF APPLICATION

This invention concerns a method to process fumes and the device which achieves the method.

The invention is applied in the field of steel production to perform a preliminary processing of the fumes discharged from the furnace before they are sent to the filtering and purification plants and discharged into the atmosphere.

The invention is applied particularly, though not exclusively, in processing fumes used to pre-heat scrap which is to be loaded into the furnaces.

The invention optimizes the combustion of CO and volatile and aromatic substances contained in the fumes, thus rendering the work of the final purification plants and discharge into the atmosphere less onerous.

The invention can be used both in completely new plants for the processing of fumes, appropriately laid out, and also in existing plants by revamping.

STATE OF THE ART

The state of the art covers steel production plants where the furnaces are loaded with scrap which has been preheated by the heat of the fumes discharged from the furnaces themselves during the melting cycles, through the aperture, or fourth hole, on the roof of the furnace.

Among the various systems to pre-heat the scrap, it is known to convey the fumes discharged from the furnace directly inside the baskets used to load the scrap by means of the appropriate pipes which are connected on one side to the fourth hole of the furnace and which cooperate on the other side with an inlet aperture made in the structure of the baskets or in their cover. The baskets are also equipped with at least one outlet aperture through which the fumes are discharged and conveyed to the purification plants and discharged into the atmosphere.

A first disadvantage of this method is that the fumes leaving the baskets, or leaving the furnace if there is no pre-heating of the scrap, travel at extremely high speed.

The high speed of the fumes prevents the purification and discharge system from functioning efficiently; the powders, particles and other polluting substances contained in the fumes are therefore retained and filtered only to a limited extent.

The high speed of the fumes, moreover, causes a premature wear of the components, particularly the filter means and the cooling means for the pipes, which are included in such plants to purify and discharge the fumes.

Furthermore, the high speed of the fumes also prevents the post-combustion processes, which may be included upstream of the purification and processing plants, from performing efficiently.

It should be considered that, in plants where the scrap is pre-heated, the fumes, which are already highly pollutant in themselves as they leave the furnaces, absorb further powders and noxious and pollutant substances as they pass through the scrap contained in the baskets.

Consequently, the filter means of the plants to purify and discharge the fumes are always working under extreme conditions, and need frequent cleaning, maintenance and/or replacement; this causes frequent and prolonged downtimes in the melting cycles and therefore a reduced productivity of the whole steel plant.

In order to limit the speed of the fumes before they are sent to the purification and discharge plants, various solutions have been proposed, but they have not shown themselves to be at all functional and/or they are very expensive and/or not very efficient.

These solutions are substantially based only on particular geometric conformations of the conduits which convey the fumes; they therefore only manage to obtain satisfactory results at the expense of construction complexity and costs, of management and maintenance.

FR-A-2105394 shows a device to process the gases arriving from a melting plant in which there are means at the inlet to induce a cyclonic development in the gases and tangential burners arranged against the current with regards to the direction of rotation of the fumes.

This device does not make it possible to reduce the speed of the fumes between the inlet and the outlet, so that in any case the processing is unsatisfactory.

U.S. Pat. No. 4,124,681 describes a gas combustion apparatus, which consists of two transit chambers arranged in series, in which the inlet of the fumes is tangential so as to obtain a substantially cyclonic development.

In this case too, however, there is no means to reduce the speed of the fumes inside the transit chambers, which therefore remains high; this reduces the efficiency of the combustion process.

U.S. Pat. No. 4,611,339 describes a method to process gases discharged from an aperture in the roof of an arc furnace, comprising a step of conducting gases to a combustion chamber where the impure gases containing the partially combusted substances released at the time of scrap preheating are treated by thermal cracking. U.S. Pat. No. 4,611,339 does not teach a step of limiting the speed of the gases transiting in the combustion chamber and so does not teach a way to improve the efficiency of the combustion process.

The present applicant has tested and embodied this invention to overcome the shortcomings of the state of the art with a solution which is relatively simple, inexpensive and highly efficient and productive.

DISCLOSURE OF THE INVENTION

The purpose of the invention is to provide a method to process the exhaust fumes discharged from furnaces in steel plants which will make the work of the purification and filtering plants less burdensome and more efficient.

A further purpose is to reduce wear and therefore the frequency of maintenance work on the purification plant, by reducing the quantity of noxious and pollutant substances, both solid and volatile, which are present in the exhaust fumes before they reach the filter systems of the plants to purify and discharge the fumes into the atmosphere.

According to the invention, the fumes discharged from the furnaces, possibly used to pre-heat the scrap to be unloaded into the furnace, before reaching the purification and discharge plants, are slowed down inside at least one expansion chamber and then subjected to a high efficiency post-combustion process.

The post-combustion process, using at least one burner, makes it possible to burn and abate at least part of the pollutant residues and the noxious compounds contained in the fumes.

According to the invention, the expansion chamber includes deflector means, at least in correspondence with the inlet; the fumes hit the deflector means, the function of which is to cause a drastic loss in the kinetic energy possessed by the fumes, and thus the speed of the fumes is drastically reduced.

Another function of the deflector means is to cause a regular expansion of the fumes over the whole volume of the first expansion chamber and to direct the fumes in the direction of the burners in order to maximise the efficiency of the post-combustion process.

The combination of three factors: the passage of the fumes through the expansion chamber, the deflector means at the inlet and the post-combustion process, together cause a drastic slow-down of the fumes, from an inlet speed of around 20÷50 meters per second to an outlet speed of around 5÷12 meters per second as the fumes leave the expansion chamber.

In order to ensure the correct processing efficiency, according to the invention the fumes are subjected to post-combustion for at least 1 second inside the expansion chamber.

According to a variant, in order to increase the combustion times and abate more efficiently the noxious and pollutant substances, the turbulence of the fumes is increased by arranging the post-combustion burners on the wall of the expansion chamber so as to create a cyclonic circulation of the fumes.

The cyclonic circulation not only slows down the fumes even further, but also encourages the various components to mix in the combustion zone, which increases the speed of combustion itself and encourages the completion of the reaction.

To this purpose, according to the invention, the burners are arranged substantially on a horizontal plane and at an angle with respect to a straight line drawn at a right angle to the wall of the expansion chamber.

According to a further variant, the burners are arranged consecutively one after the other, so that each burner cooperates with the burner immediately adjacent to it, in such a way as to accentuate the cyclonic circulation of the fumes inside the expansion/combustion chamber.

This causes a further decrease in the transit speed of the fumes, and causes the fumes to remain in correspondence with the area subject to the action of the burners for a longer period of time.

In one embodiment of the invention, there are at least three burners, arranged substantially at the same height, and at an angle with respect to a straight line drawn at a right angle to the wall of the expansion chamber and distributed symmetrically on the perimeter of the latter.

According to a variant, there are several groups of burners arranged on different levels along the lengthwise extension of the expansion chamber.

The cyclonic circulation of the fumes caused by the action of the burners also encourages the abatement and the separation of the solid pollutant substances, such as powders and particles, which are suspended in the fumes and are a product of the post-combustion process.

According to a variant, downstream of the expansion/combustion chamber there is at least a second expansion chamber through which the fumes are made to pass before being sent to the purification systems and the chimney.

According to the invention, the expansion chamber(s) cooperate(s) with at least an area where the solid pollutant substances abated are collected and stored.

According to one embodiment, the at least one collection and storage area cooperates with means to extract the solid pollutant substances contained therein.

According to a further variant, the extraction means are driven automatically.

ILLUSTRATION OF THE DRAWINGS

The attached figures are given as a non-restrictive example and show some preferred embodiments of the invention as follows FIG. 1 shows a side view of a device achieving the method according to the invention in a system which includes the pre-heating of the scrap loaded by means of baskets;

FIG. 2 shows a first embodiment of the invention;

FIG. 3 shows a lengthwise cross-section of the device used in the system shown in FIG. 1;

FIG. 4 shows a section from A to A of FIG. 3;

FIG. 5 shows a functional diagram of FIG. 3.

Figures 1, 5:
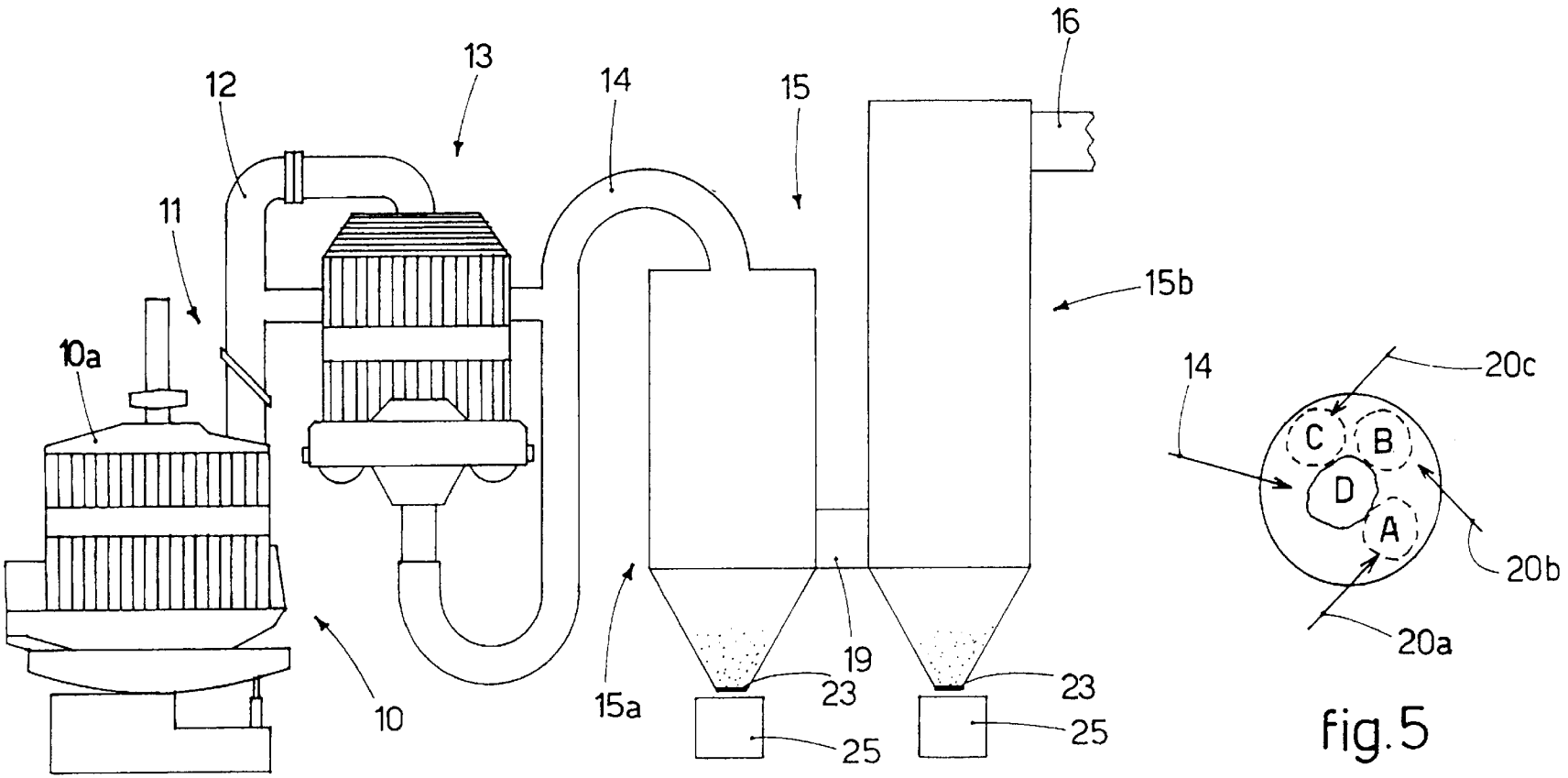
FIG. 1 shows a furnace 10, in this case of the electric arc type, the roof 10*a* of which has an aperture 11, or fourth hole, used to discharge the fumes produced inside the furnace 10 during the melting cycles.

The following description refers to the case where the scrap to be loaded into the furnace is pre-heated by using the fumes from the furnace 10; it goes without saying that the invention can also be applied in those cases where the pre-heating procedure is not included.

In this case, the fumes discharged from the fourth hole 11 are conveyed, by means of a conduit 12, inside a basket 13 loaded with scrap in order to pre-heat the said scrap.

After the fumes have lapped the scrap contained inside the basket 13 and given up at least part of their heat energy to the scrap, they are discharged from the basket 13, in this case, from the bottom, and sent by means of a cooled conduit 14 inside the device 15 which achieves the method to process fumes according to the invention.

The device 15 is associated at the outlet with a conduit 16 cooperating with the final purification plant 24 for the fumes, which in turn is associated with the chimney through which the fumes are expelled into the atmosphere.

In the embodiments shown in FIGS. 1 and 3, the device 15 consists of two expansion chambers, respectively the first chamber 15*a* and the second chamber 15*b*, located in sequence and connected by a conduit 19. In FIG. 2 there is a single expansion chamber 15*a*.

The fumes 17 leave the loading basket 13 through the conduit 14 at a high speed, which can even reach as much as 20÷50 meters per second.

The first expansion chamber 15*a* has an inlet, in this case, a wider section 215*a* cooperating at the centre with a deflector element 18.

The deflection element 18, in this case, has an upper surface 18*a* substantially conical in shape with the top turned and facing the aperture for the inlet of the fumes 17, and a lower surface 18*b* shaped like a truncated cone with the smaller base turned towards the inside of the first expansion chamber 15*a*.

In the embodiment shown in FIG. 2, the substantially conical upper surface 18*a* is greatly rounded, so as to assist the passage of the fumes 17 over the faces of the deflector element 18.

The lateral surfaces of the deflector element 18 are also greatly rounded.

The cooperation between the wider section 215*a* and the deflector element 18 causes the fumes 17 to decelerate drastically and to expand regularly over the whole volume of the first expansion chamber 15*a*.

The speed of the fumes 17 is reduced, according to the invention, from a value of 20 to 50 meters per second to a value of between 5 and 12 meters per second.

The shape of the deflector element 18 also causes an increase in the turbulence of the fumes 17, thus ensuring a further slow-down in the speed and an efficient mixing of the components.

According to the invention, below the deflector element 18 there is a first group of burners 20 arranged substantially on the same horizontal plane so as to define a first level 21*a*.

In the case shown in FIG. 4, there are four burners 20 arranged at an angle with respect to a straight line drawn at a right angle to the wall of the first expansion chamber 15*a*. In this case, the burners 20 are arranged inclined downwards and facing in the same direction as the fumes 17, thus encouraging the separation and removal of the solid substances 22 which collect on the bottom part 115*a* of the first expansion chamber 15*a*.

In the embodiments shown, below the first level 21*a* there is a second level 21*b* of burners 20.

According to a variant which is not shown here, there three or more levels 21 of burners 20 arranged along the height of the first expansion chamber 15*a*.

According to the invention, the inclined arrangement of the burners 20 causes and accentuates the cyclonic and turbulent circulation of the fumes 17, which further reduces the transit speed of the fumes 17.

This slow-down has the double advantage that it increases the time the fumes 17 remain affected by the action of the burners 20, and that it reduces the force of impact which the fumes have on the purification and filter systems 24 located downstream, reducing the wear thereon and increasing the efficiency thereof.

The cyclonic circulation, moreover, assists the various components to mix in the combustion zone, thus increasing the combustion speed itself and encouraging the completion of the reaction.

The cyclonic circulation of the fumes causes a better abatement and sedimentation of the solid pollutant substances 22, for example powders or particles, which are suspended in the fumes 17 and are a product of the post-combustion process.

In this case, the solid pollutants 22 collect on the bottom part 115*a* of the first expansion chamber 15*a*.

The slow-down of the fumes caused by the combined action of the wider section 215*a*, the deflector element 18 and the burners 20 causes the fumes 17 to remain inside the first expansion chamber 15*a* for at least one second.

This period of time allows the burners 20 to perform an optimum post-combustion process which acts on almost all the noxious and pollutant substances contained in the fumes 17.

According to FIG. 3, the fumes 17 are subjected to post-combustion and deceleration by burners, respectively 20*a*, 20*b* and 20*c*, arranged around the inlet to the expansion chamber 15*a*. Each burner 20*a*, 20*b* and 20*c* is directed in such a way that it acts respectively on zones A, B and C arranged substantially at a tangent to the median zone D wherein the fumes 17 are introduced by the cooled conduit 14 (FIG. 5).

This arrangement of the burners 20*a*, 20*b* and 20*c* causes the fumes 17 to take on a cyclonic development immediately as they enter the first combustion chamber 15*a*, remaining substantially trapped inside the central zone D and allowing combustion to reach a very high degree of completion.

In the embodiments shown in FIGS. 1 and 3, the fumes 17 pass from the first expansion chamber 15*a* through the conduit 19 to the second expansion chamber 15*b*.

The second expansion chamber 15*b* not only stabilises the fumes 17 before they are sent to the purification plants 24 and for expulsion into the atmosphere, it also makes it possible to recover, on its own bottom part 115*b*, those solid pollutant substances 22 which were not retained in the first expansion chamber 15*a* and are still suspended in the fumes 17.

In the second expansion chamber 15*b*, the direction of advance of the fumes 17 is inverse to that of the fumes in the first expansion chamber 15*a*.

This inversion of direction is obtained by introducing the fumes 17 into the second expansion chamber 15*b* from below by means of the conduit 19, and by making them leave from the top through the duct 16; it causes a further reduction in the speed of the fumes 17, which arrive at the purification systems 24 and the chimney located downstream at a much lower speed.

According to FIG. 3, there is at least a burner 20 at least at one level 21, in the second expansion chamber 15*b* too.

The burner(s) (20) in the second expansion chamber 15*b* can be arranged at an angle in the opposite direction to the direction of the fumes 17, which also facilitates the separation and removal of the powders and solid substances 22.

According to a variant, the burners 20 in the second expansion chamber 15*b* are inclined upwards and facing in the same direction as the fumes 17.

In this case, the bottom parts 115*a* and 115*b* of the respective expansion chambers, the first 15*a* and the second 15*b*, cooperate with extraction means 23 and containing means 25, advantageously governed by automatic drive systems, which make it possible to expel and discharge the solid pollutant substances 22 which have been deposited there.

What is claimed is:

1. A method to process fumes discharged directly from a furnace (10) through an aperture (11) in a roof or from a loading basket (13) of the furnace used to pre-heat scrap which is to be loaded into said furnace (10), the fumes (17) afterwards being sent to a purification plant (24) and to a chimney, the fumes (17) leaving at least one member of the group consisting of the furnace (10) and the loading basket (13) through a cooled conduit (14) being made to pass through at least a first transit chamber where the fumes are subjected to a post-combustion process before being sent to said purification plant (24) and said chimney, said first transit chamber comprises a first expansion chamber (15*a*) and the fumes entering said first expansion chamber (15*a*) expand in correspondence with a wider section (215*a*) therein at an inlet thereto and are deflected by a deflector element (18) arranged substantially at the center of said wider section (215*a*), the expansion and deflection causing the fumes to decelerate from a speed at the inlet of the first expansion chamber of around 20 to 50 meters per second to a speed at an outlet of the first expansion chamber of around 5 to 12 meters per second, the fumes then being subjected to a post-combustion process by means of at least one burner (20) arranged on the walls of said first expansion chamber (15*a*) and below said deflector element (18).

2. The method as in claim 1, in which said deflector element (18) induces turbulence on the fumes.

3. The method as in claim 1, in which the fumes (17) passing in correspondence with a zone of said at least one burner (20) are made to circulate in a turbulent and substantially cyclonic development by an angled arrangement of said at least one burner (20) with respect to a straight line drawn at a right angle to the walls of said first expansion chamber (15*a*).

4. The method as in claim 1, in which the fumes (17) are made to remain in a zone wherein said at least one burner (20) is located for at least 1 second.

5. The method as in claim 1, which includes at least two successive post-combustion processes generated by at least two burners (20) arranged on relative levels (21*a*, 21*b*) located at different heights along the walls of said first expansion chamber (15*a*).

6. The method as in claim 1, in which between said first expansion chamber (15*a*) and said purification plant (24) there is at least a second expansion chamber (15*b*) wherein the fumes (17) circulate in the opposite direction to that of said first expansion chamber (15*a*).

7. The method as in claim 6, which includes at least a post-combustion process achieved in said second expansion chamber (15*b*).

8. The method as in claim 1, in which between said first expansion chamber (15*a*) and said purification plant (24) there is at least a second expansion chamber (15*b*), and solid pollutant substances (22) suspended in the fumes (17), are abated and separated by the post-combustion process, and are collected in correspondence with a respective bottom part (115*a*, 115*b*) of at least one member of the group consisting of said first expansion chamber (15*a*) and said second expansion chamber (15*b*) and discharged by extraction means.

9. A device to process fumes leaving an aperture (11) in the roof of a furnace, the device being placed between a cooled conduit (14) which conveys the fumes leaving the furnace (10) or from loading containers (13) serving to pre-heat scrap and a duct (16) to send the fumes to a purification system (24) and a chimney, the device comprising:

at least a transit chamber equipped with at least one post-combustion burner (20), wherein said transit chamber comprises a first expansion chamber (15*a*) for the fumes (17) and comprises at an inlet therein a wider section (215*a*) cooperating, in a substantially central position, with a deflector element (18) arranged in a position which at least partly faces an aperture through which the fumes (17) are introduced into said expansion chamber (15*a*), said at least one post-combustion burner (20) arranged on the walls of said first expansion chamber (15*a*) and below said deflector element (18).

10. The device as in claim 9, in which an upper part (18*a*) of said deflector element (18) is substantially conical in shape with its top turned towards the aperture through which the fumes (17) enter, and in which a lower part (18*b*) of said deflector element (18) is substantially shaped like a truncated cone having a relatively larger base and a relatively smaller base, with the smaller base turned towards a bottom part of said first expansion chamber (15*a*).

11. The device as in claim 9, in which at least an upper vertex of said deflector element (18) is rounded.

12. The device as in claim 9, which comprises a plurality of burners (20) arranged on at least one level (21*a*) of said first expansion chamber (15*a*) below said deflector element (18) and inclined with respect to a straight line drawn at a right angle to the wall of said first expansion chamber (15*a*), the burners (20) defining a consecutive sequence where a zone of influence of one said burner (20) substantially borders with a zone of influence of an adjacent said burner (20).

13. The device as in claim 9, in which at least one said burner (20) is arranged in cooperation with an upper wall of said first expansion chamber (15*a*).

14. The device as in claim 9, which comprises a second expansion chamber (15*b*) connected with said first expansion chamber (15*a*) by means of a conduit (19), said second expansion chamber (15*b*) being connected to said duct (16) which sends the fumes (17) to said purification system (24) and to said chimney.

15. The device as in claim 14, in which said conduit (19) cooperates with a lower part of said second expansion chamber (15*b*) and said duct (16) cooperates with an upper part of said second expansion chamber (15*b*).

16. The device as in claim 14, which includes at least one burner (20) arranged in cooperation with the walls of said second expansion chamber (15*b*).

17. The device as in claim 9, in which between said first expansion chamber (15*a*) and said purification plant (24) there is at least a second expansion chamber (15*b*), and on a respective bottom part (115*a*, 115*b*) of at least one member of the group consisting of said first expansion chamber (15*a*) and said second (15*b*) expansion chamber cooperate with extraction means (23) and containing means (25) wherein solid pollutant substances (22) collect and are deposited.

18. The device as in claim 12, in which at least one said burner (20) is arranged in cooperation with an upper wall of said first expansion chamber (15*a*).

19. The method as in claim 1, wherein solid pollutant substances (22) suspended in the fumes (17), are abated and separated by the post-combustion process, and are collected in correspondence with a bottom part (115*a*) of said first expansion chamber (15*a*) and discharged by extraction means.

20. The device as in claim 9, in which a bottom part (115*a*) of said first expansion chamber (15*a*) cooperates with extraction means (23) and contains means (25) wherein solid pollutant substances (22) collect and are deposited.

* * * * *